US007141124B2

(12) United States Patent
Rusciolelli

(10) Patent No.: US 7,141,124 B2
(45) Date of Patent: Nov. 28, 2006

(54) PROCESSES AND COMPOSITIONS FOR USE IN GARMENT RESTORATION

(75) Inventor: J. Michael Rusciolelli, 6301 Brent Dr., Springfield, IL (US) 62707

(73) Assignee: J. Michael Rusciolelli, Springfield, IL (US)

( * ) Notice: Subject to any disclaimer, the term of this patent is extended or adjusted under 35 U.S.C. 154(b) by 0 days.

(21) Appl. No.: 10/434,245

(22) Filed: May 8, 2003

(65) Prior Publication Data

US 2004/0221873 A1 Nov. 11, 2004

(51) Int. Cl.
*B08B 3/00* (2006.01)

(52) U.S. Cl. ..... 134/30; 134/25.1; 134/25.4; 134/26; 134/39; 134/42; 422/5; 510/108; 510/276; 510/281; 510/291; 8/137

(58) Field of Classification Search ..... 8/107, 8/111, 137, 158, 159, 137.5, 139; 134/19, 134/25.1, 25.4, 25.5, 31, 32, 34, 38, 39, 40, 134/42, 2, 20, 26; 510/108, 276, 281, 291, 510/292, 109; 422/5

See application file for complete search history.

(56) References Cited

U.S. PATENT DOCUMENTS

| | | | | | |
|---|---|---|---|---|---|
| 1,362,658 | A * | 12/1920 | Willford | 8/137 |
| 3,194,628 | A * | 7/1965 | Cannon | 8/137 |
| 5,178,828 | A * | 1/1993 | Uesugi | 422/22 |
| 5,181,399 | A * | 1/1993 | Engel et al. | 68/13 R |
| 5,213,773 | A * | 5/1993 | Burris | 422/256 |
| 5,241,720 | A * | 9/1993 | Engel et al. | 8/158 |
| 5,493,743 | A * | 2/1996 | Schneider et al. | 8/149.2 |
| 5,645,608 | A * | 7/1997 | Cooper et al. | 8/137 |
| 5,763,382 | A * | 6/1998 | Cooper et al. | 510/303 |
| 5,928,490 | A * | 7/1999 | Sweeney | 205/700 |
| 5,960,501 | A * | 10/1999 | Burdick | 8/158 |
| 6,272,770 | B1 * | 8/2001 | Slutsky et al. | 34/596 |
| 6,408,471 | B1 * | 6/2002 | Teran et al. | 8/158 |
| 6,673,121 | B1 * | 1/2004 | Mettlach et al. | 8/149.1 |
| 6,750,191 | B1 * | 6/2004 | Kasturi et al. | 510/417 |
| 2002/0073491 | A1 * | 6/2002 | Mettlach et al. | 8/149.1 |

FOREIGN PATENT DOCUMENTS

| | | | |
|---|---|---|---|
| JP | 3-146094 | * | 6/1991 |
| JP | 5-161773 | * | 6/1993 |
| JP | 409276882 | * | 10/1997 |
| JP | 2000-5483 | * | 1/2000 |

OTHER PUBLICATIONS

N. Schiff. After the Fire is Out. The case for Wet cleaning, Where practical. 1999. www.schiff-consulting.com/fire.html.*

Internet Archive "Wayback Machine" search for http://www.schiff-consulting.com/fire.html.*

N.Schiff. After the Fire is Out. The case for Wet Cleaning, Where Practical. Copyright 2000.*

Jon-Don, information sheet from website, 2 pages, printed Mar. 29, 2003.

Laundry Today, information sheet from website, 2 pages, printed Mar. 29, 2003.

Air Pure, Ozone information sheet from website, 3 pages, printed Mar. 29, 2003.

Buy-Internet-Direct.com, information sheet from website, 1 page, printed Mar. 29, 2003.

Iris City Cleaners & Laundering Co., information sheet from website, 2 pages, printed Mar. 29, 2003.

The Disaster Handbook 1998 National Edition, Institute of Food and Agricultural Sciences, University of Florida, information from website, 6 pages, printed Mar. 29, 2003.

* cited by examiner

*Primary Examiner*—M. Kornakov
(74) *Attorney, Agent, or Firm*—Polsinelli Shalton Welte Suelthaus PC

(57) ABSTRACT

The present invention relates to process and methods, as well as compositions and systems for use in laundering smoke-damaged garments. In particular, the present invention utilizes ozonated water to treat the smoke-damaged garments.

14 Claims, 3 Drawing Sheets

PROCESSES AND COMPOSITIONS FOR USE IN GARMENT RESTORATION

TECHNICAL FIELD

The present invention relates to processes or methods, compositions, and systems used for laundering garments, and other fabric articles, and in particular to processes and compositions for restoring smoke and water damaged garments and other fabric articles. The preferred composition includes ozone ($O_3$), which is added to water to form ozonated water.

BACKGROUND

When smoke and water damage garments, including clothing, window treatments, bedding, fabrics, textiles and related articles (collectively "garments" and will be referred to as such throughout this document), these garments need to be restored. Conventional restoration processes have been used to try and remove the carbon-based stains, odor causing contaminants, soot, and microbes from smoke and water damaged garments. The known processes include laundering methods, as well as, conventional dry cleaning. Typically, restoration occurs in about 50% to 60% of the total number of garments treated, with restoration occurring when an owner will accept the garment as being fit for use or wear. The garments, which are not accepted, are deemed unfit and discarded. Disposal of such a high percentage of garments is expensive and considered unacceptable. For this reason, it is desired to have a process that restores approximately 90% of all smoke-damaged garments.

Known laundering processes use detergents to clean the smoke and water damaged garments, while dry cleaning processes use conventional chemical compositions associated with dry cleaning. These processes are typically ineffective in restoring smoke and water damaged clothing and, in many cases, cause additional damage to the fabric or dye of such garments. Additionally, even if minimally effective, multiple launderings or dry cleanings of these garments are usually required for restoration. In rare cases is a full restoration achieved, and these multiple launderings or dry cleanings are wasteful of resources and expensive. As such, it is desired to have a process or composition that results in a higher percentage of garments being restored. More particularly, it is desired to have a process that does not require multiple treatments.

Ozone is a bluish colored gas, which is composed of three atoms of oxygen, illustrated as $O_3$. Typically, "oxygen" has two atoms of oxygen, illustrated as $O_2$. $O_3$ is unstable and rapidly decomposes into normal $O_2$. The $O_3$ is known to have good oxidation potential, which translates into desired cleaning of garments. In particular, dirt can be readily removed, similar to washing a garment. Ozone has been previously used in printed circuit board manufacturing, plastics manufacturing, water purification, and food processing. Ozone has also been used as part of known laundry processes. Typically, it has been used to clean hotel bed sheets, as it is comparatively inexpensive and readily disinfects. However, $O_3$ has not been used to remove "smoke" particles from garments. Additionally, ozone compositions typically do not break-down or degrade garments. It should also be pointed out that $O_3$ destroys bacteria and virus, and controls odor.

It is desired to have compositions, methods, and systems for restoring smoke damaged garments. Such process should be available for use in an industrial setting. It is further desired that such invention not be comparatively too expensive. Finally, while removing the "smoke" particles, the garments should not be substantially degraded or faded.

SUMMARY

The present invention is directed to processes, compositions, and systems, used to restore smoke and water-damaged garments. The processes utilize ozone ($O_3$) contacted or mixed with cooled water to form ozonated water, contacted with the garments. This is done while the ozone is at its maximum potential for oxidizing the carbon particles and microbes in the garment associated with the smoke and water damage. More particularly, the ozonated water results in the garments being restored most of the time. The complexed ozone-carbon particles/microbes, coupled with the water, remove the carbon particles from the garments, allowing for the restoration of the garment. This process is typically a single process, and as such avoids multiple washings with detergents, or dry cleanings, that are wasteful of resources, expensive and typically result in the use of environmentally unfriendly chemicals.

The method or process relates to restoring smoke-damaged garments. The method includes forming an ozonated water composition formed from water, ozone, and additives, and contacting the ozonated water composition with at least one garment. The water is at a temperature ranging between 35° F. and 75° F., with a temperature of approximately 55° F. more preferred. The ozone is added to the water in an amount equal to between 0.550 ppm and 0.750 ppm. The method includes the steps of rinsing the garments, washing the garments, and extracting the garments. Each of the steps is conducted for an amount of time ranging between 30 seconds and ten (10) minutes. Further, each of the steps can be repeated at least once. The washing step, also known as the suds bath, includes contacting the garments with the ozonated water composition.

The ozone is preferably formed using a pre-charged tank having between 500 mV and 800 mV oxygen reducing potential (ORP). The ozone is then added to the water, preferably in a vortex.

The additives include solvents, alkali builders, surfactants, bleaches, odor controllers, and sour and softening agents. The additives are added in an amount equal to between 0.5 oz. additive/10 lbs. of garments and 3 oz. additive/10 lbs. of garments. However, other amounts can be added dependent upon the additive, the size of the washer, and the amount of garments. Preferred additives include cold water detergents and solvents.

The invention includes a method of using ozonated water to restore smoke-damaged garments. The method includes obtaining the smoke-damaged garments, forming an ozonated water composition, and washing the garments with the ozonated water composition.

Additionally, the invention relates to a wash water composition, which restores smoke-damaged garments. The wash water composition includes water, ozone, additives, and smoke damaged garments.

The system is used for treating the damaged garments. The system includes at least one water carrier, an ozonater in communication with the water carrier, and a chamber for holding objects to be treated with ozonated water. The chamber is in communication with at least one water carrier, at a point beyond where said ozonator is in communication with the water carrier.

Use of ozone reduces chemical consumption, water consumption, and energy expenses. Energy use is reduced by using cooler wash water temperatures and shorter machine cycles. Also, the invention reduces fabric degradation, environmental surcharges, washroom floor productivity, color fastness, and fabric life.

BRIEF DESCRIPTION OF THE DRAWINGS

Attention is now directed to the drawings, where like numerals and characters indicate like or corresponding components. In the drawings.

DETAILED DESCRIPTION OF THE DRAWINGS

The present invention relates to processes or methods, compositions, and systems for use in treating smoke-damaged garments. The ozonated water composition includes water, ozone, and additives. Once the ozonated water and additives are mixed, an ozonated water composition is formed. The ozonated water composition is then used as part of a process to clean and restore smoke damaged garments. The present invention also relates to a system for use in cleaning and treating smoke damaged garments. In particular, the present invention relates to the use of ozonated water to restore smoke damaged garments. In the garment restoration industry, carbon-based stains, as well as odor causing contaminates, must be removed from all water washable fabric types without damage to the garment's fabric or dye. By using the present method, compositions, and system, the criteria for garment restoration is met through the use of ozonated water, additives, and correct washer formulas.

The garments to be treated can be of any of a variety of colors (both white and dark colors) and formed from any of a variety of materials. The garments are treated as part of a batch process; however, it is contemplated that it might be possible to treat the garments as part of a continuous process. Typically, the garments will be treated in 60 or 100 pound (lbs.) batches, as this is the size of most commercially available washers. Both lightly and heavily damaged garments can be treated.

The process is initiated by placing the garments in the washer. Once in the washer, ozonated water, as well as additives, can be added to and mixed with the garments. There are at least three steps which are performed to clean and treat the garments. The steps include rinsing, suds bath, and extraction. These steps can be repeated, with different additives, or combinations of additives, mixed during each step. The suds bath is the step associated with cleaning or removing carbon and soot from the garment. During the suds bath, most of the additives are mixed with the ozonated water, with the additives designed to remove dirt and soot. It is preferred to perform multiple steps, especially multiple suds baths. As such, each step is performed for between 30 seconds and ten (10) minutes. The amount of additive mixed with the water will depend upon the additive and the amount of damage. Preferably, the additive is added in an amount ranging between 0.5 ounces (oz.) of additive/10 lbs. of garments and 3 oz. of additive/10 lbs. of garments. Other amounts can be used dependent upon the additive and amount of damage done to the garment. The ozone is preferably formed using a pre-charged tank having between 500 mV and 800 mV ORP.

Figure 1:
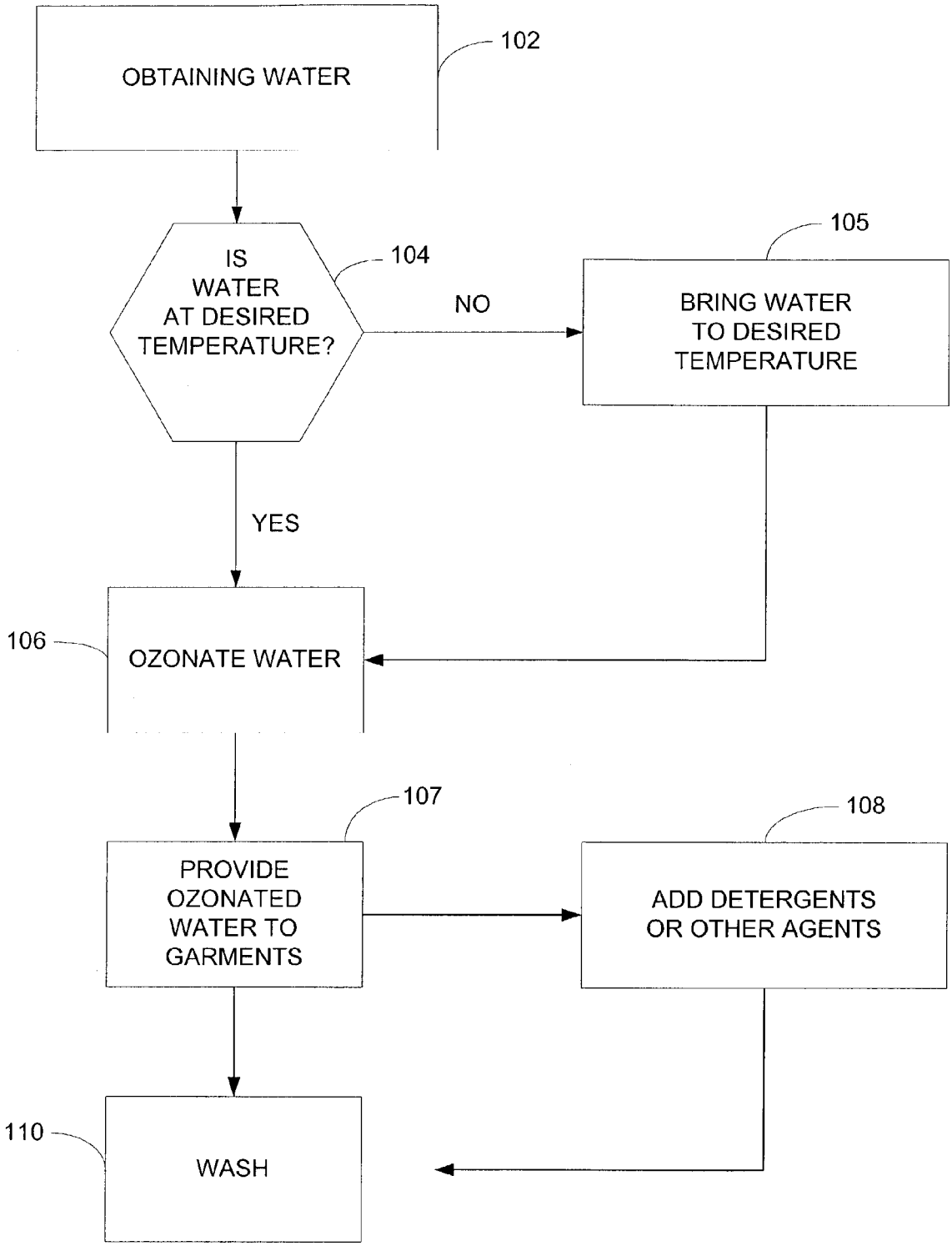
FIG. 1 is flow diagram of a process of an embodiment of the present invention.

FIG. 1 shows a flow diagram of an example process and system in accordance with an embodiment of the invention. In this process, the majority of garments are restored with ozonated water that forms the wash water of the suds bath step. The ozonated water contains ozone at concentrations sufficient to contribute to the removal or neutralization of most carbon particles and microbes associated with smoke and water damage including the odor associated therewith. As such, the ozonated water contributes to the removal of these particles from the garments, such that they are carried away by the wash water.

The wash water, ozonated water, can further include additives, such as various detergents and other chemical agents. Available additives include solvents, alkali builders, surfactants, bleaches, odor controllers, souring, and softening agents, alone or in various combinations. The additives will be discussed in more detail; however, any of a variety of additives can be used which clean the garments.

The process is initiated by obtaining water, as shown at block 102. The temperature of the water is taken at block 104. If the water is not at the desired temperature, it may be necessary to cool (and, alternatively, in some cases, heat) the water at block 105. Any temperature may be used so long as the water composition, in particular the ozonated water, effectively eliminates smoke and carbon particles. Comparatively cooler temperatures are generally selected because it is believed that ozone is more effective in comparatively cooler temperatures.

The cooling step is illustrated at block 105. It is preferred for the water to have a temperature ranging between 35° F. and approximately 75° F. It is most preferred for the water to have a temperature of about 55° F. As such, the ozone, when added to the water at this temperature is typically effective as a restoring agent. It should be noted that the cooling step is not required if the water is at an already acceptable temperature.

Water that is at the requisite temperature, is ozonated, as shown at block 106. Any of a variety of methods can be used to ozonate the water. Ozonation includes contacting the water in a tank with ozone. Contact can be facilitated by injecting the ozone into the water of the tank at a point below the water level, so that ozone directly contacts the water. Alternatively, ozonation can be performed by injecting ozone into the water of the tank at close proximity to the water level. Another alternative involves adding ozone to water as it flows into a tank. The most preferred method is to generate ozone with a pre-charged tank followed by mixing the ozone into the water in a vortex.

In general, there are four optional methods available for delivery of the ozone into the wash bath. The methods include:

1. Bubbling—This involves pumping the ozone into the wash bath. The ozone bubbles will rise through the water to reach the top.
2. Side Arm—This method circulates the water through an externally mounted pipe (side arm) and the ozone is injected via an orifice into the water stream.
3. Direct injection—This method injects ozone into the incoming water supply and into the machine.
4. Pre-charged tank—This method forms the ozone in a separate tank followed by addition to the water in a tank under vacuum. The ozone level is monitored and controlled via an oxygen reducing potential (ORP) device, and measured in milliVolts (mV). The ozonated water is then delivered to a washer or washers via a pump and plastic piping. In the pre-charged tank, ozone levels are typically effective for this process are at approximately 600 mV to approximately 800 mV ORP, with approximately 700 mV to approximately 750mV ORP preferred. These voltages are typically detected by voltage meters, with amounts of ozone for placement into the water typically controlled by an ORP controller.

Throughout the ozonation step of the process the water temperature, both before and after ozonation, is preferably maintained at approximately 55° F. Ozonation occurs, typically, in response to garments being placed into a wash tub or chamber of a washing machine or the like, and accordingly, starting the wash cycle for the washing machine. Water is preferably added to the washer, followed by the ozonated water.

The ozonation system uses ambient air as an air source, whereby air is passed into a separator. While in the separator, nitrogen and other gases are removed from the ambient air, leaving about 90% by volume molecular oxygen ($O_2$). The molecular oxygen is converted to ozone ($O_3$). The ozone is transferred to a mixer motor, which rotates water at a speed sufficient to create a vortex. Ozone is transported through a hollow shaft in the mixer motor and injected into the vortex under a vacuum (the vacuum created by the vortex). This results in a mixing between the ozone and the water that keeps the ozone and the water together for a comparatively longer period of time than with conventional water/ozone systems.

The water is pumped from the holding tank, where the ozonated water is located, through a length of the piping, where it is distributed to washers. Typically, this occurs when the washer control opens the valve to fill. Any unused water is passed through a heat exchanger to cool the water to 55° F. and returned to the tank, where it is mixed with existing ozonated water. The ozone concentration is controlled to maintain the desired ozone concentration, and the water temperature is maintained at 55° F.

The ozonated water is then contacted with the garments, shown at block 107. Typically, the garments are in a washing machine, for example, a standard commercial washing machine, and in the wash tub or chamber. The wash tub is typically a 60 lb. or 100 lb. capacity washer. The garments can either be placed into the washtub prior to entry of the ozonated water therein or the ozonated water can first be placed into the washtub with the garment(s) added later.

In an optional step, at block 108, additives can be combined with the ozonated water. This step, at block 108, is optional and can be bypassed as the process goes directly from block 107 to block 110. Additives may be added to the ozonated water before contact with the garments or when the ozonated water is in contact with the garments.

Alternately, prior to contact with the ozonated water, there can be a pretreat or presoak step. Here, for example, non-ozonated water with additives can be provided to the garments before the ozonated water, with or without ozonated water composition, contacts the garments. Ozonated water may also be used in the pre-contact step.

Available additives include detergents, solvents, surfactants, bleaches, odor controllers, and souring and softening agents. The additives are used with the ozonated water to clean and treat the garment. Specifically, the use of the additives results in the removal of carbon contaminants, soot, dirt, and any other constituent that stains or causes a foul smell on the garment. The additives preferably work in cooler temperatures. The additives are formulated to perform optimally in cooler temperatures and in an ozone environment without premature degradation.

Detergents include any substance that reduces the surface tension of water, specifically a surface-active agent which concentrates at oil-water interfaces, exerts emulsifying action, and, thus, aids in removing soils. Such detergents should work in comparatively cool temperatures.

The surface-active agents, or surfactants, include any compound that reduces surface tension when dissolved in water or water solutions, or which reduces interfacial tension between two liquids, or between a liquid and a solid.

Solvents include substances capable of dissolving another substance (solute) to form a uniformly dispersed mixture (solution) at the molecular-or ionic-size level. The solvents can be either polar (high dielectric constant) or non-polar (low dielectric constant).

The bleach is used to whiten a textile by chemical action. Bleaching agents include hydrogen peroxide (the most common), sodium hypochlorite, sodium peroxide, sodium chlorite, calcium hypochlorite, hypochlorous acid, and many organic chlorine derivatives.

Sour includes any substance used in textile or laundry operations to neutralize residual alkali or decompose residual hypochlorite bleach. The commonly used sours are sodium bifluoride and sodium fluosilicatc.

Specific solvents and detergents include d-limonene based solvents, alkali builders, tallow based surfactants, oxygen bleach, odor controllers, and souring and softening agents. Citrus solutions are optionally included. Additives that cleanse in comparatively cool water temperatures are most preferred. These chemicals or constituents may be added individually or in combinations and can be added at the desired times in the wash cycle. However, not all chemicals need to be added to the ozonated water and, in some cases, the aforementioned ozonated water may be sufficient to clean and restore the garments. All of the above mentioned additives should work in cooler temperatures.

As part of the system, the additives are placed in labeled reservoirs. This allows for control by a computer as to when a specific additive is added to the wash. The additives are typically included as part of the suds bath step. The preferred reservoirs are labeled, for example, as follows and include the listed preferred additives:

F1=Liquid solvent/surfactant blend consisting of ethoxylated nonylphenol and diethylene glycol butyl ether;

F2=Blended alkaline cleaner consisting of potassium hydroxide, and nitrilo triacetic acid, and tri sodium salt;

F3=Concentrated surfactant/solvent blend consisting of diethylene glycol butyl ether, 1, 2-propanediol, and propylene glycol;

F4=Hydrogen peroxide;

F5=Blended alkaline cleaner, ammonia, at less than 5% by weight; and,

F6=Acidic/cationic aqueous blend, consisting of hydroxyacetic acid and glycolic acid.

In order to maintain consistency in product delivery, all chemicals or additives are preferably liquid in nature. The chemicals are added by a computer controlled peristaltic pump system. Upon initial start-up, and at periodic maintenance intervals, the pumping ratios (oz/min) are determined. Each washer formula has a corresponding chemical pump formula. Dependent upon the garments, a program is selected, which determines when to add a particular chemical and in what amount. The chemical pump system determines the quantity to be dosed upon the formula number. A flush manifold is used to flush the chemical through the delivery tubing into the washer with, preferably, cold, non-ozonated water. This ensures the chemical dosing is accurate and is in the washer when it is required.

At block 110, the process of washing and cleaning the garments includes rinsing, suds bath, and extract. These steps can be performed for any of a variety of times. Also, these steps can be repeated. The steps are preferably computer controlled so that programs are established, which will wash garments according to type, amount, and level of damage. The intent is to contact the garments with the ozonated water and additives for a sufficient amount of time to substantially remove the contaminants. The amount of time for each step can range between 30 seconds and five (5) minutes.

A preferred method for cleaning garments includes multiple rinses and multiple suds bath treatments. For example, when treating white cotton garments, a cleaning program is initiated by contacting the garments with an amount of water for approximately 3 minutes, followed by adding detergents and solvents, and washing for about 7 minutes. The garments are then rinsed for a period of time, such as 7 minutes, followed by a second suds bath. The second suds bath will be for approximately 9 minutes, and will include detergents and bleach. The additive and ozonated water is then drained from the garments and another suds bath is conducted. The third suds bath will, again, have the same constituents as the previous one. After the third suds bath, the garments are rinsed. The garments are then rinsed and soured, followed by extraction. As can be seen, a number of steps can be repeated in an attempt to restore the smoke-damaged garments.

More specifically, the wash cycle continues, at block 110. This wash cycle is typically such that garments are exposed to ozonated wash water for at least approximately 30 seconds to ten (10) minutes. If desired, the aforementioned process of steps 102–110 may be repeated, should one or more repetitions be desired.

Figure 2:
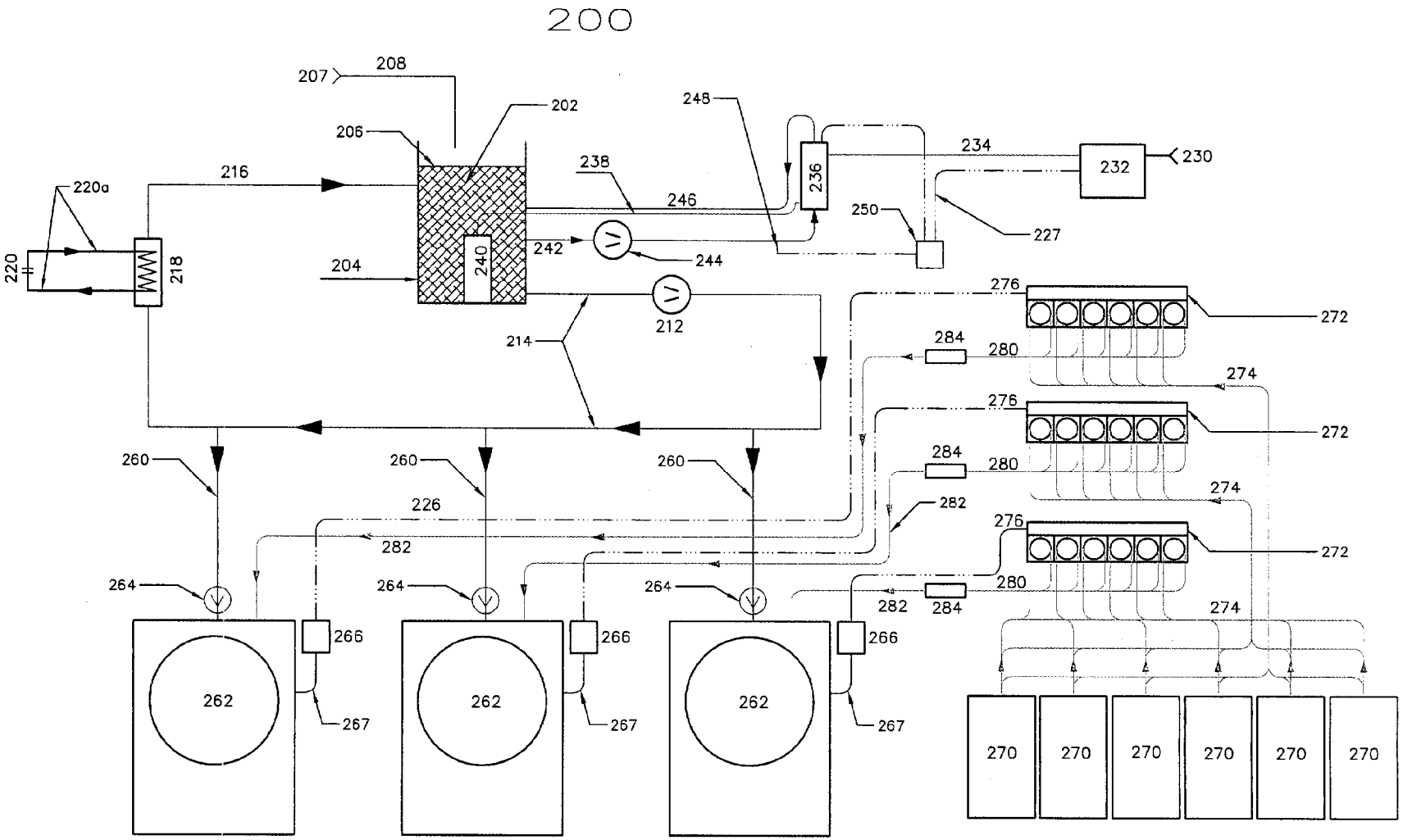
FIG. 2 is a schematic diagram of a system suitable for performing processes in accordance with embodiments of the present invention.

FIG. 2 shows an exemplary system 200 suitable for performing an embodiment of the present invention for garment restoration. Water 202 is provided to a tank (or bath) 204 at a desired level 206, where it is ozonated by an ozonation system. The water 202 is typically from a municipal or other external source 207 over a line 208. The water traveling along this line 208 may also be subjected to purification, filtration by various known mechanisms placed along this line 208.

The ozonated water 202 is also pumped from the tank by a pump 212, that functions continuously, to circulate and return the water to the tank 204. This circulation pathway (whose flow direction is indicated by the arrowheads) is formed by a first line 214, along which the pump 212 sits and a second line 216, that returns water to the tank 204. The first 214 and second 216 lines join at a heat exchanger 218, that includes a heating mechanism and also communicates with a chiller 220, through which fluid circulates in a closed loop 220*a*, to chill the water passing through the heat exchanger 218 from the first line 214 to the second line 216.

The ozonation system functions as an ambient air, at source 230, is received by a separator 232. While in this separator 232, nitrogen and other gases are removed from the ambient air, leaving only molecular oxygen ($O_2$). The molecular oxygen travels along the line 234 into an ozone chamber 236, where the molecular oxygen ($O_2$), is converted to ozone ($O_3$). The ozone travels along line 238 to a mixer motor 240 in the tank 204. This mixer motor 240 rotates, for example, as speeds of approximately 1725 rpm, or any other speed sufficient to create a vortex of the water 202 in the tank 204. Ozone is transported through a hollow shaft in the mixer motor 240 and injected into the vortex under a vacuum (the vacuum created by the vortex). This results in a mixing between the ozone and the water that keeps the ozone and the water together for a comparatively longer period of time than with conventional water/ozone systems.

Egress line 242, through which water is drawn, extends from the tank 204 to the ozone chamber 236. A pump 244 sits along this line 242, for drawing water from the tank to the jacket of the ozone chamber 236, for cooling the ozone chamber 236. This cooling water is returned to the tank 204 through a return line 246.

An ozone reduction potential (ORP) sensor 248 is along the egress line 242. An ORP meter 250 is in communication with the separator 232, ozone chamber 236 and ORP sensor 248. The ORP meter 250 adjusts ozone concentrations when necessary, so that ozone concentrations are within a suitable range, for example, between approximately 500 mV to approximately 800 mV.

Ozonated water, of a sufficient temperature, typically between approximately 35° to 75° F., is continuously pumped by the pump 212, at sufficient pressures, such that the ozonated water enters sublines 260, that feed washing machines 262. Valves (V) 264 along the sublines 260 control water flow into the respective washing machines 262. The valves 264 are controlled by a PLC that is part of the washing machine 262. The valves 264 are opened in accordance with signals received from the programmable logic controllers (PLC) of the washing machine 262 (in electronic communication with the respective valves 264 by wired or wireless links) for each of the washing machines 262 (connected thereto by wired 267 or wireless links). PLC 266 controls the amount of chemicals provided by reservoirs 270.

These PLCs 266 are processors, or other computer-type devices. They are capable of executing programs in software, hardware, or combinations thereof, for various programs associated with washing and garment restoration.

Chemicals are stored in reservoirs 270, representative of plural reservoirs. These chemicals in the reservoirs 270 are typically in liquid form. These chemicals typically include, and are identified (by identifier) in this document as follows:

| CHEMICAL | IDENTIFIER |
|---|---|
| d-limonene based solvent | F1 |
| alkali builder | F2 |
| Tallow based surfactant | F3 |
| Oxygen Bleach | F4 |
| Odor Controller | F5 |
| Sour and soften agent | F6 |

The reservoirs 270 are connected to chemical feed pumps 272, by lines 274. The chemical feed pumps 272 are individual pumps corresponding to each reservoir 270. The PLCs 266 are in electronic communication with the chemical feed pumps 272 by wired 276 or wireless links. The signals received from the respective PLC 266 control the specific amounts of chemicals from the reservoirs 270 that will be fed into each specific washing machine 262.

The pumps of the chemical feed pumps 272 connect to the washing machines 262 by first 280 and second 282 fluid delivery lines. The first 280 and second 282 fluid delivery lines connect at flush manifolds 284. These flush manifolds 284 connect to water sources (not shown), such as municipal water systems, auxiliary water tanks and the like, and combine water (typically non-ozonated), when necessary in accordance with the program running in the PLC 266, with the chemicals or mixtures thereof that are being pumped to the respective washing machines 262 (and delivered over delivery lines 282).

Figure 3:
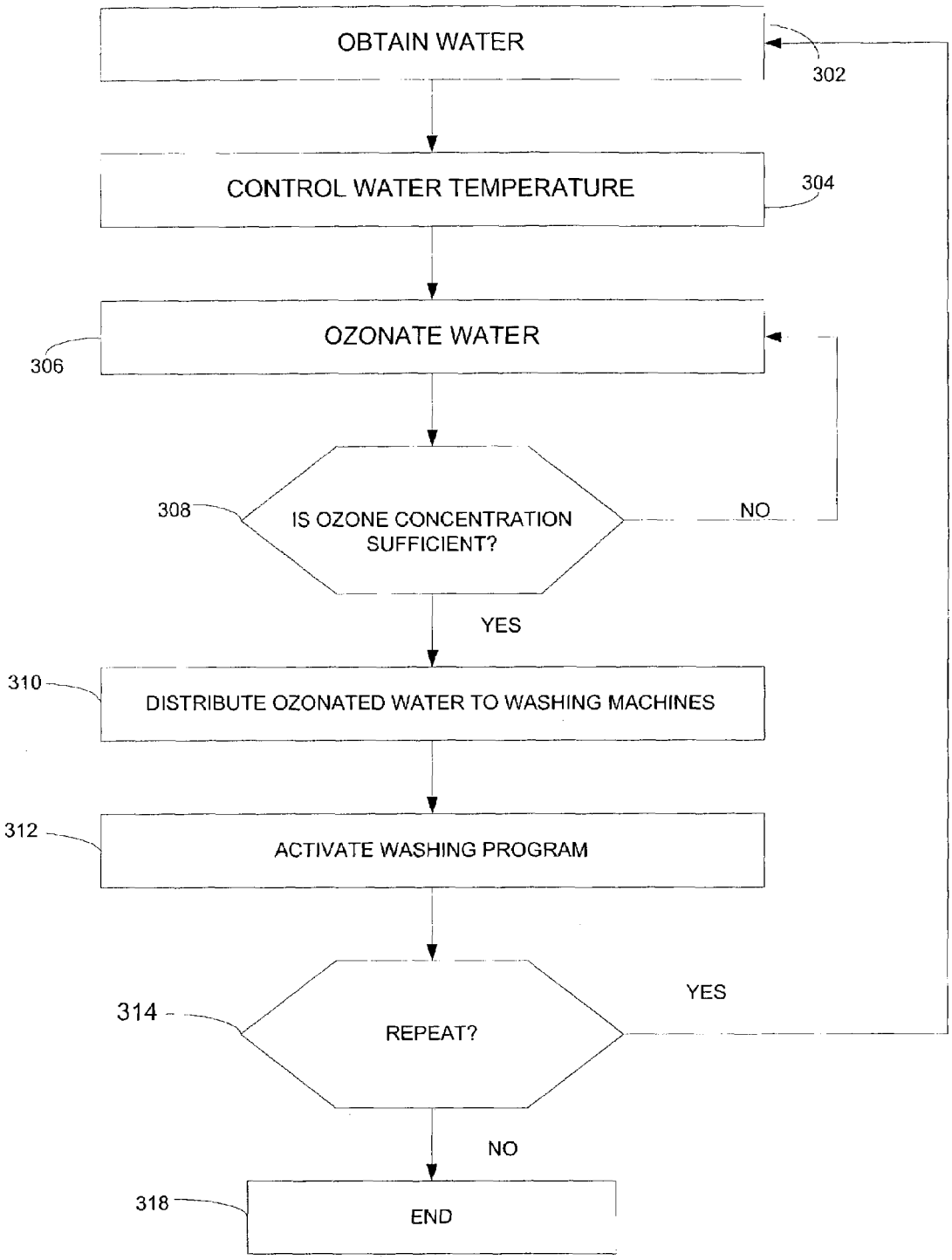
FIG. 3 is a flow diagram of a process of another embodiment of the present invention that can be used with the system of FIG. 2.

FIG. 3 details an exemplary process in accordance with an embodiment of the present invention, employing, for example, the system of FIG. 2. While this example process is typically controlled by the PLCs 266 with software, hardware or combinations thereof, it can also be performed manually. Additionally, the process can also be performed in a combination of automated (PLC controlled) and manual steps.

Initially water is obtained at block 302. For example, water is obtained for the tank 204 typically from a municipal source 207, as well as upon recirculation from the circulation system formed by the pump 212, lines 214, 216 and heat exchanger 218. At block 304, the temperature of water 202 in the tank (or bath) 204 is controlled by the water passing through the heat exchanger 218, where it is heated or cooled depending on the desired water operational temperature.

The water 202 in the tank 204 is ozonated, by the ozonation system detailed above, at block 306. Ozonation levels are then checked for sufficiency, at block 308. This is performed by the ozone reduction potential (ORP) sensor 248 along the egress line 244, that senses ozone potential in millivolts. When concentrations are inadequate, for example, under 500 mV or over 800 mV, the process returns to block 306, and the ORP meter 250, in communication with the separator 232, ozone chamber 236 and ORP meter 250, pumps ozone into the tank 204 through the pump 240, as detailed below.

With ozone concentration sufficient, the water is distributed to the washing machines 262 at block 310. Through the PLC's 266, associated with each washing machine 262, a washing program is activated at block 312. This activation may include adding chemicals from the reservoirs 270, as pumped through the chemical feed pumps 272 and mixed with water in the flush manifolds 284, in accordance with the washing program of the PLC.

The process can be repeated, depending on the program being run by the PLC 266, at block 314. If repeated, the process returns to block 304. Otherwise, the process ends at block 316.

Examples of processes in accordance with embodiments of the present invention are provided below. These examples include washing programs as well as compositions and mixtures of ozonated water and detergents and/or chemicals for wash water. These examples are not limiting of the invention, and are as follows.

EXAMPLES

Example 1

The present Example relates to a process and composition that was used to treat smoke damaged garments. In particular, the method and composition were used to treat white cotton garments damaged in a home fire. Two sets of garments were treated, 60 lbs. and 100 lbs.

The compositions used in the process are referred to as Formulas 1–7 (F1–F7). The chemical identification of each formula is:

F1 is a solvated d-limonene-based solvent detergent designed for laundering linens exposed to high carbon content soils and other particulate byproducts of combustion. The detergent includes surfactants and Natural Terpenes to solubilize and emulsify these contaminates. The product was made by Custom Compounders, Inc. (Arnold, Mo.).

F2 is an alkaline builder based on potassium salts, and includes neutralizers and peptizers for superior soil suspension. The product is made by Custom Compounders, Inc. (Arnold, Mo.).

F3 is a tallow-based surfactant detergent. F3 is highly concentrated, with a blend of polymers and anti-redeposition agents unique to combustion byproducts. The product was made by Custom Compounders, Inc. (Arnold, Mo.).

F4 is an oxygen-based bleach. The product was made by Custom Compounders, Inc. (Arnold, Mo.).

F5 is an odor controlling chemical formulated to chemically complex organic combustion byproducts in a manner which structurally prevents odor evolution. The product was made by Custom Compounders, Inc. (Arnold, Mo.).

F6 is a combination chemical neutralizer and fabric-conditioning agent which eliminates static charges on the laundered linens. The product was made by Custom Compounders, Inc. (Arnold, Mo.).

F7 is a "linen finishing" formulation utilizing natural starches as well as synthetic polymers. The product was made by Custom Compounders, Inc. (Arnold, Mo.).

In order to maintain consistency in product delivery, all chemicals were liquid in nature. The chemicals were added by a computer controlled peristaltic pump system. The reservoir and pump system were connected to the washing machine.

Each washer formula had a corresponding chemical pump formula. The washer determined what program was being run and when to dose what chemical. The chemical pump system determined the quantity to be dosed, based upon the formula number.

The process was initiated by forming $O_3$ in water at a temperature of 55° F. The $O_3$ was added in an amount sufficient to equal a concentration of about 650 ppm. Ozone levels were typically effective for this process at approximately 600 milliVolts (mV) to approximately 800 mV, with approximately 700 mV to approximately 750 mV preferred. These voltages were typically detected by voltage meters, with amounts of ozone for placement into the water typically controlled by an ORP controller. The system used was a Pre-charged Tank, manufactured by Puro-Tek.

Once formed, the ozonated water was added to a washer, which already had the garments added thereto. The selected washer was a Unimac washer.

A flush manifold was used to flush the chemical through the delivery tubing into the washer with cold, non-ozonated water. This ensured that the chemical dosing was accurate and was in the washer when it was required.

The steps of the performed process are listed in the below table. Included is the time and amounts of the constituents added.

| | Step | Par | Time | Description | oz./Dose | |
|---|---|---|---|---|---|---|
| ID | 1 | S9 | 0:01 | Program ID | 60 lb. | 100 lb. |
| Break | 2 | WM | 3:00 | Warm, Med Level, Bottom fill only | 5.00 | 8.0 |
| | 3 | S2 | 0:10 | F2 | 6.00 | 10.00 |
| | 4 | S3 | 0:10 | F3 | | |
| | 5 | W1 | 7:00 | Wash | | |
| | 6 | D1 | 1:00 | Drain | | |
| Flush | 7 | WH | 3:00 | Warm, High Level, Fill | | |
| | 8 | W1 | 2:00 | Flush | | |
| | 9 | D1 | 1:00 | Drain | | |
| Bleach Bath | 10 | WM | 3:00 | Warm, Med Level, Fill | 4.00 | 6.00 |
| | 11 | S2 | 0:10 | F2 | 5.00 | 8.00 |
| | 12 | S3 | 0:10 | F3 | 4.00 | 6.00 |
| | 13 | S4 | 0:10 | F4 | | |
| | 14 | W1 | 6:00 | Bleach Bath | | |
| | 15 | D1 | 1:00 | Drain | | |
| 2nd Bleach Bath | 16 | WM | 3:00 | Warm, Med Level, Fill | 1.50 | 2.00 |
| | 17 | S2 | 0:10 | F2 | 2.50 | 4.00 |
| | 18 | S3 | 0:10 | F3 | 2.50 | 4.00 |
| | 19 | S4 | 0:10 | F4 | | |
| | 20 | W1 | 4:00 | Second Bleach Bath | | |
| | 21 | WH | 3:00 | Warm, High Level, Fill | | |
| | 22 | W1 | 2:00 | Second Bleach Bath, High Level | | |
| | 23 | D1 | 1:00 | Drain | | |
| Rinse | 24 | WH | 3:00 | Warm Fill, High Level Fill | 3.00 | 5.00 |
| | 25 | S6 | 0:10 | F5 | | |
| | 26 | W1 | 3:00 | Rinse | | |
| | 27 | D1 | 1:00 | Drain | | |
| Rinse/Sour | 28 | MS | 0:30 | Med Seed Ext, w/o Slow Down | 3.00 | 5.00 |
| | 29 | WR | 1:00 | Warm Spray Rinse | 1.00 | 1.50 |
| | 30 | WM | 3:00 | Warm, Med Level Fill | | |
| | 31 | S6 | 0:10 | F5 | | |
| | 32 | S7 | 0:10 | F6 | | |
| | 33 | W1 | 4:00 | Rinse | | |
| | 34 | D1 | 1:00 | Drain | | |
| Extract | 35 | H3 | 4:00 | High Seed Extract w/0:45 Slow2 | | |
| | 36 | A3 | 0:05 | Buzzer | | |
| | 37 | END | | | | |

The below table lists the solvents and detergents with more particularity.

The above was done in a 60 lb. and a 100 lb. capacity washer. After the above process was performed, 92% of the total garments were accepted by customers.

Example 2

The Example relates to a process and composition that was used to treat smoke damaged garments. In particular, the method and composition were used to treat white polyester garments damaged in a home fire. The chemicals and equipment were the same as in Example 1. The difference was in the selected cycle and program used.

| | Step | Par | Time | Description | oz./Dose | |
|---|---|---|---|---|---|---|
| ID | 1 | S9 | 0:03 | Program ID | 60 lb. | 100 lb. |
| Break | 2 | WM | 3:00 | Warm, Med Level | 5.00 | 8.0 |
| | 3 | S2 | 0:10 | F2 | 6.00 | 10.00 |
| | 4 | S3 | 0:10 | F3 | | |
| | 5 | W1 | 7:00 | Wash | | |
| | 6 | D1 | 1:00 | Drain | | |
| Flush | 7 | WH | 3:00 | Warm, High Level, Fill | | |
| | 8 | W1 | 2:00 | Flush | | |
| | 9 | D1 | 1:00 | Drain | | |
| Bleach Bath | 10 | WM | 3:00 | Warm, Med Level, Fill | 4.00 | 6.00 |
| | 11 | S2 | 0:10 | F2 | 5.00 | 8.00 |
| | 12 | S3 | 0:10 | F3 | 4.00 | 6.00 |
| | 13 | S4 | 0:10 | F4 | | |
| | 14 | W1 | 6:00 | Bleach Bath | | |
| | 15 | D1 | 1:00 | Drain | | |
| 2nd Bleach Bath | 16 | WM | 3:00 | Warm, Med Level, Fill | 1.50 | 2.00 |
| | 17 | S2 | 0:10 | F2 | 2.50 | 4.00 |
| | 18 | S3 | 0:10 | F3 | 2.50 | 4.00 |
| | 19 | S4 | 0:10 | F4 | | |
| | 20 | W1 | 4:00 | Second Bleach Bath | | |
| | 21 | WH | 3:00 | Warm, High Level, Fill | | |

-continued

| | Step | Par | Time | Description | oz./Dose | |
|---|---|---|---|---|---|---|
| | 22 | W1 | 2:00 | Second Bleach Bath | | |
| | 23 | D1 | 1:00 | Drain | | |
| Rinse | 24 | WH | 3:00 | Warm Fill, High Level Fill | 3.00 | 5.00 |
| | 25 | S6 | 0:10 | F5 | | |
| | 26 | W1 | 3:00 | Rinse | | |
| | 27 | D1 | 1:00 | Drain | | |
| Rinse/Sour | 28 | MS | 0:30 | Med Seed Ext, w/o | 3.00 | 5.00 |
| | 29 | WR | 1:00 | Warm Spray Rinse | 1.00 | 1.50 |
| | 30 | WM | 3:00 | Warm, Med Level Fill | | |
| | 31 | S6 | 0:10 | F5 | | |
| | 32 | S7 | 0:10 | F6 | | |
| | 33 | W1 | 4:00 | Rinse | | |
| | 34 | D1 | 1:00 | Drain | | |
| Extract | 35 | MS | 4:00 | Med Seed Extract w/ | | |
| | 36 | A3 | 0:05 | Buzzer | | |
| | 37 | END | | | | |

After the above process was performed, 92% of the total garments were accepted by customers.

Example 3

The present Example relates to a process and composition that was used to treat smoke damaged garments. In particular, the method and composition were used to treat dark cotton garments damaged in a home fire. The chemicals and equipment were the same as in Example 1. The difference was in the selected cycle and program used.

After the above process was performed, 92% of the total garments were accepted by customers.

Example 4

The present Example relates to a process and composition that was used to treat smoke damaged garments. In particular, the method and composition were used to treat dark polyester garments damaged in a home fire. The chemicals and equipment were the same as in Example 1. The difference was in the selected cycle and program used.

| | Step | Par | Time | Description | oz./Dose | |
|---|---|---|---|---|---|---|
| ID | 1 | S9 | 0:05 | Program ID | 60 lb. | 100 lb. |
| Break | 2 | WM | 3:00 | Warm, Med Level, Bottom fill only | 5.00 | 8.0 |
| | 3 | S2 | 0:10 | F2 | 6.00 | 10.00 |
| | 4 | S3 | 0:10 | F3 | | |
| | 5 | W1 | 7:00 | Wash | | |
| | 6 | D1 | 1:00 | Drain | | |
| Flush | 7 | WH | 3:00 | Warm, High Level, Fill | | |
| | 8 | W1 | 2:00 | Flush | | |
| | 9 | D1 | 1:00 | Drain | | |
| Bleach Bath | 10 | WM | 3:00 | Warm, Med Level, Fill | 4.00 | 6.00 |
| | 11 | S2 | 0:10 | F2 | 5.00 | 8.00 |
| | 12 | S3 | 0:10 | F3 | | |
| | 13 | S4 | 0:10 | 1st Carryover | | |
| | 14 | D1 | 1:00 | Drain | | |
| 2nd Bleach Bath | 15 | WM | 3:00 | Warm, Med Level, Fill | 1.50 | 2.00 |
| | 16 | S2 | 0:10 | F2 | 2.50 | 4.00 |
| | 17 | S3 | 0:10 | F3 | | |
| | 18 | W1 | 4:00 | Second Bleach Bath | | |
| | 19 | WH | 3:00 | Warm, High Level, Fill | | |
| | 20 | W1 | 2:00 | Carryover High Level | | |
| | 21 | D1 | 1:00 | Drain | | |
| Rinse | 22 | WH | 3:00 | Warm Fill, High Level Fill | 3.00 | 5.00 |
| | 23 | S6 | 0:10 | F5 | | |
| | 24 | W1 | 3:00 | Rinse | | |
| | 25 | D1 | 1:00 | Drain | | |
| Rinse/Sour | 26 | MS | 0:30 | Med Seed Ext, w/o Slow Down | 3.00 | 5.00 |
| | 27 | WR | 1:00 | Warm Spray Rinse | 1.00 | 1.50 |
| | 28 | WM | 3:00 | Warm, Med Level Fill | | |
| | 29 | S6 | 0:10 | F5 | | |
| | 30 | S7 | 0:10 | F6 | | |
| | 31 | W1 | 4:00 | Rinse | | |
| | 32 | D1 | 1:00 | Drain | | |
| Extract | 33 | H3 | 4:00 | High Seed Extract w/0:45 Slow Down | | |
| | 34 | A3 | 0:05 | Buzzer | | |
| | 35 | END | | | | |

| | Step | Par | Time | Description | oz./Dose | |
|---|---|---|---|---|---|---|
| ID | 1 | S9 | 0:07 | Program ID | 60 lb. | 100 lb. |
| Break | 2 | WM | 3:00 | Warm, Med Level, Bottom fill only | 5.00 | 8.0 |
| | 3 | S2 | 0:10 | F2 | 6.00 | 10.00 |
| | 4 | S3 | 0:10 | F3 | | |
| | 5 | W1 | 7:00 | Wash | | |
| | 6 | D1 | 1:00 | Drain | | |
| Flush | 7 | WH | 3:00 | Warm, High Level, Fill | | |
| | 8 | W1 | 2:00 | Flush | | |
| | 9 | D1 | 1:00 | Drain | | |
| Bleach Bath | 10 | WM | 3:00 | Warm, Med Level, Fill | 4.00 | 6.00 |
| | 11 | S2 | 0:10 | F2 | 5.00 | 8.00 |
| | 12 | S3 | 0:10 | F3 | | |
| | 13 | S4 | 0:10 | 1st Carryover | | |
| | 14 | D1 | 1:00 | Drain | | |
| 2nd Bleach Bath | 15 | WM | 3:00 | Warm, Med Level, Fill | 1.50 | 2.00 |
| | 16 | S2 | 0:10 | F2 | 2.50 | 4.00 |
| | 17 | S3 | 0:10 | F3 | | |
| | 18 | W1 | 4:00 | Second Bleach Bath | | |
| | 19 | WH | 3:00 | Warm, High Level, Fill | | |
| | 20 | W1 | 2:00 | Carryover High Level | | |
| | 21 | D1 | 1:00 | Drain | | |
| Rinse | 22 | WH | 3:00 | Warm Fill, High Level Fill | 3.00 | 5.00 |
| | 23 | S6 | 0:10 | F5 | | |
| | 24 | W1 | 3:00 | Rinse | | |
| | 25 | D1 | 1:00 | Drain | | |
| Rinse/Sour | 26 | MS | 0:30 | Med Seed Ext, w/o Slow Down | 3.00 | 5.00 |
| | 27 | WR | 1:00 | Warm Spray Rinse | 1.00 | 1.50 |
| | 28 | WM | 3:00 | Warm, Med Level Fill | | |
| | 29 | S6 | 0:10 | F5 | | |
| | 30 | S7 | 0:10 | F6 | | |
| | 31 | W1 | 4:00 | Rinse | | |
| | 32 | D1 | 1:00 | Drain | | |
| Extract | 33 | MS | 4:00 | Medium Seed Extract w/0:30 Slow Down | | |
| | 34 | A3 | 0:05 | Buzzer | | |
| | 35 | END | | | | |

After the above process was performed, 92% of the total garments were accepted by customers.

Example 5

The present Example relates to a process and composition that was used to treat smoke damaged garments. In particular, the method and composition were used to rinse cotton garments damaged in a home fire. The chemicals and equipment were the same as in Example 1. The difference was in the selected cycle and program used.

After the above process was performed, 92% of the total garments were accepted by customers.

Example 6

The Example relates to a process and composition that was used to treat smoke damaged garments. In particular, the method and composition were used to rinse polyester garments damaged in a home fire. The chemicals and equipment were the same as in Example 1. The difference was in the selected cycle and program used.

| | Step | Par | Time | Description | oz./Dose | |
|---|---|---|---|---|---|---|
| ID | 1 | S9 | 0:09 | Program ID | 60 lb. | 100 lb. |
| Break | 2 | WH | 3:00 | Warm, High Level, Fill | 3 | 5 |
| | 3 | S6 | 0:10 | F5 | 0.7 | 1 |
| | 4 | S7 | 0:10 | F6 | | |
| | 5 | W1 | 5:00 | Rinse w/Odor and Sour | | |
| | 6 | D1 | 1:00 | Drain | | |
| Extract | 7 | H3 | 4:00 | High Seed Extract w/0:45 Slow Down | | |
| | 8 | A3 | :05 | Buzzer | | |
| | 9 | END | | | | |

| | Step | Par | Time | Description | oz./Dose | |
|---|---|---|---|---|---|---|
| ID | 1 | S9 | 0:11 | Program ID | 60 lb. | 100 lb. |
| Break | 2 | WH | 3:00 | Warm, High Level, Fill | 3 | 5 |
| | 3 | S6 | 0:10 | F5 | 0.7 | 1 |
| | 4 | S7 | 0:10 | F6 | | |
| | 5 | W1 | 5:00 | Rinse w/Odor and Sour | | |
| | 6 | D1 | 1:00 | Drain | | |
| Extract | 7 | H3 | 4:00 | High Seed Extract w/0:45 Slow Down | | |
| | 8 | A3 | :05 | Buzzer | | |
| | 9 | END | | | | |

After the above process was performed, 92% of the total garments were accepted by customers.

Example 7

The present Example relates to a process and composition that was used to treat smoke damaged garments. In particular, the method and composition were used to treat white personal garments damaged in a home fire. The chemicals and equipment were the same as in Example 1. The difference was in the selected cycle and program used.

| | Step | Par | Time | Description | oz./Dose | |
|---|---|---|---|---|---|---|
| ID | 1 | S9 | 0:13 | Program ID | 60 lb. | 100 lb. |
| Bleach Bath | 2 | WH | 3:00 | Warm, High Level, Fill | 1.5 | 2 |
| | 3 | S2 | 0:10 | F2 | 2.5 | 4 |
| | 4 | S3 | 0:10 | F3 | 1.5 | 2 |
| | 5 | S4 | 0:10 | F4 | | |
| | 6 | W1 | 6:00 | Bleach Bath | | |
| | 7 | D1 | 1:00 | Drain | | |
| Rinse | 8 | WH | 3:00 | Warm Fill, High Level Fill | | |
| | 9 | W1 | 2:00 | Rinse | | |
| | 10 | D1 | 1:00 | Drain | | |
| Rinse/Sour | 11 | MS | 0:30 | Med Seed Ext, w/o Slow Down | 0.3 | 0.5 |
| | 12 | WR | 1:00 | Warm Spray Rinse | | |
| | 13 | WM | 3:00 | Warm, Med Level Fill | | |
| | 14 | S7 | 0:10 | F6 | | |
| | 15 | W1 | 4:00 | Rinse | | |
| | 16 | D1 | 1:00 | Drain | | |
| Extract | 17 | H3 | 4:00 | High Seed Extract w/0:305 Slow Down | | |
| | 18 | A3 | :05 | Buzzer | | |
| | 19 | END | | | | |

After the above process was performed, 92% of the total garments were accepted by customers.

Example 8

The Example relates to a process and composition that was used to treat smoke damaged garments. In particular, the method and composition were used to treat dark personal garments damaged in a home fire. The chemicals and equipment were the same as in Example 1. The difference was in the selected cycle and program used.

| | Step | Par | Time | Description | oz./Dose | |
|---|---|---|---|---|---|---|
| ID | 1 | S9 | 0:13 | Program ID | 60 lb. | 100 lb. |
| Bleach Bath | 2 | WM | 3:00 | Warm, Med Level, Fill | 1.5 | 2 |
| | 3 | S2 | 0:10 | F2 | 2.5 | 4 |
| | 4 | S3 | 0:10 | F3 | | |
| | 5 | W1 | 6:00 | Bleach Bath | | |
| | 6 | D1 | 1:00 | Drain | | |
| Rinse | 7 | WH | 3:00 | Warm Fill, High Level Fill | | |
| | 8 | W1 | 2:00 | Rinse | | |
| | 9 | D1 | 1:00 | Drain | | |
| Rinse/Sour | 10 | MS | 0:30 | Med Seed Ext, w/o Slow Down | 0.3 | 0.5 |
| | 11 | WR | 1:00 | Warm Spray Rinse | | |
| | 12 | WM | 3:00 | Warm, Med Level Fill | | |
| | 13 | S7 | 0:10 | F6 | | |

-continued

| | Step | Par | Time | Description | oz./Dose |
|---|---|---|---|---|---|
| | 14 | W1 | 4:00 | Rinse | |
| | 15 | D1 | 1:00 | Drain | |
| Extract | 16 | H3 | 4:00 | High Seed Extract w/0:305 Slow Down | |
| | 17 | A3 | :05 | Buzzer | |
| | 18 | END | | | |

After the above process was performed, 92% of the total garments were accepted by customers.

Example 9

The present Example relates to a process and composition that was used to treat smoke damaged garments. In particular, the method and composition were used to treat white cotton garments heavily damaged in a home fire. The chemicals and equipment were the same as in Example 1. The difference was in the selected cycle and program used.

After the above process was performed, 92% of the total garments were accepted by customers.

Example 10

The garment restoration savings and success rate was measured. This was done over 3 months. Some initial methods and compositions were eliminated because they did not work to satisfaction. The data, however, was included herewith.

| | Step | Par | Time | Description | oz./Dose | |
|---|---|---|---|---|---|---|
| ID | 1 | S9 | 0:21 | Program ID | 60 lb. | 100 lb. |
| Wash | 2 | WM | 3:00 | Warm, Med Level, Bottom fill only | 7 | 12 |
| | 3 | S1 | 0:10 | F1 | 7 | 12 |
| | 4 | S2 | 0:10 | F2 | 7 | 12 |
| | 5 | S3 | 0:10 | F3 | | |
| | 6 | W1 | 9:00 | Wash | | |
| | 7 | D1 | 1:00 | Drain | | |
| 2nd Wash | 8 | WM | 3:00 | Warm, Med Level, Fill | 6 | 10 |
| | 9 | S2 | 0:10 | F2 | 6 | 10 |
| | 10 | S3 | 0:10 | F3 | | |
| | 11 | W1 | 6:00 | Second Wash | | |
| | 12 | D1 | 1:00 | Drain | | |
| Flush | 13 | WH | 3:00 | Warm, High Level, Fill | | |
| | 14 | W1 | 2:00 | Flush | | |
| | 15 | D1 | 1:00 | Drain | | |
| Bleach Bath | 16 | MS | 0:30 | Med Seed Ext, w/o Slow Down | 5 | 8 |
| | 17 | WR | 1:00 | Warm Rinse | 5 | 8 |
| | 18 | WM | 3:00 | Warm Med Level Fill | 4 | 6 |
| | 19 | S2 | 0:10 | F2 | | |
| | 20 | S3 | 0:10 | F3 | | |
| | 21 | S4 | 0:10 | F4 | | |
| | 22 | W1 | 6:00 | Wash | | |
| | 23 | D1 | 1:00 | Drain | | |
| 2nd Bleach Bath | 24 | WM | 3:00 | Warm, Med Level, Fill | 4 | 6 |
| | 25 | S4 | 0:10 | F4 | | |
| | 26 | W1 | 6:00 | Wash | | |
| | 27 | WH | 3:00 | Warm, High Level, Fill | | |
| | 28 | W1 | 3:00 | Wash | | |
| | 29 | D1 | 1:00 | Drain | | |
| Rinse | 30 | MS | 0:30 | Med Seed Ext, w/o Slow Down | 3 | 5 |
| | 31 | WR | 1:00 | Warm Spray Rinse | | |
| | 32 | WH | 3:00 | Warm, High Level, Fill | | |
| | 33 | S6 | 0:10 | F5 | | |
| | 34 | W1 | 3:00 | Rinse | | |
| | 35 | D1 | 1:00 | Drain | | |
| Rinse | 36 | WM | 3:00 | Warm, Med Level Fill | 3 | 5 |
| | 37 | S6 | 0:10 | F5 | 1 | 1.5 |
| | 38 | S7 | 0:10 | F6 | | |
| | 39 | W1 | 4:00 | Rinse | | |
| | 40 | D1 | 1:00 | Drain | | |
| Extract | 41 | H3 | 4:00 | High Seed Extract w/0:45 Slow Down | | |
| | 42 | A3 | 0:05 | Buzzer | | |
| | 43 | END | | | | |

| | TIME EQUALS 3 MONTHS |
|---|---|
| Total garment pieces restored | 121,001 |
| Average garment pieces per job | 937.9 |
| Average replacement cost of garment | $25.00 |
| Average savings per job when compared to average dry cleaner success rates (45% to 55%) | $10,786.00 |
| Total savings when compared to average dry cleaner success rates (45% to 55%) | $1,391,512 |

Example 11

The present Example relates to methods for restoring the smoke damaged garments.

| WATER SUPPLY | RAW WATER | OZONE WATER |
|---|---|---|
| | into building<br>76° F. to 78° F.<br>pH 8.0 to 8.5<br>80 to 90 ppm<br>or approximately<br>5 gms/gallon | from hand wash<br>81° to 83° F.<br>pH 8.0–8.5<br>80 to 90 ppm<br>or approximately<br>5 gms/gallon |

The following devices were checked to ensure accuracy.

WASHERS Water levels, dump valves and fill valves all were good on all three machines PUMPS/CHEMICALS—All chemical supply lines appear to be good—full—no air gaps (except the right side of hand wash)

All peristaltic pinch tubes—okay

All supply flush lines to washers—okay

The formula was changed from previous experiments.

| |
|---|
| Discontinued use of Builder on colored loads 7/22<br>(Nos. 3, 4, 13, and 14)<br>Reacting to fading of colored garments complaint<br>from a couple of claims. In the past, with E.L.,<br>discontinuing alkalinity corrected color fading problem<br>No other formula changes of chemical dosing on<br>times were altered |

The following tests were conducted;

Washer No. 4 (85 lb. North)

| Prog. #3 | | Chemicals | | | | | |
|---|---|---|---|---|---|---|---|
| Dark Colors-Cotton (Light Fire) | | F2 | F3 | F5 | F6 | Alk | pH |
| 1st Suds | 7 min | -0- | 10 oz. | | | -0- | 6.5 |
| Flush | 2 min | | | | | -0- | 7.5/8.5 |
| 2nd Suds | 6 min | -0- | 6 oz. | | | -0- | 6.5/7.0 |
| 3rd Carryover | 6 min | -0- | 3 oz. | | | -0- | 6.5/7.0 |
| Odor Rinse | 3 min | | | 4 oz. | | -0- | 7.0/7.5 |
| Med Spin | :30 sec | | | | | | |
| Spray Rinse | 1 min | | | | | | |
| Final Rinse | 4 min | | | 4 oz | 3 oz. | -0- | 6.0/6.5 |
| Extract/End | 4 min | | | | | | |

Comments: No Builder was added. Never observed any measurable alkalinity. Always observed pH around neutral. The slight step upward of pH on Flush is explained by water supply.

Next, another test was conducted

| Prog. #13 Dark Colors - | | Chemicals | | | | | |
|---|---|---|---|---|---|---|---|
| Cotton (Heavy Fire) | | F2 | F3 | F5 | F6 | Alk | pH |
| 3rd Suds | 8 min | -0- | | | | (.1 to .2) | 8.0/8.5 |
| Rinse | 2 min | -0- | | | | (.1 to .2) | 8.0/8.5 |
| Med Spin | :30 sec | -0- | | | | | |
| Spray Rinse | 1 min | -0- | | | | | |
| Odor Rinse | 2 min | | | 4 oz. | | (.2) | 8.5 |
| Final Rinse | 4 min | | | 4 oz. | 3 oz. | -0- | 6.0/6.5 |
| Extract/End | | | | | | | |

Comments: No Builder was added. No measurable levels of alkalinity. Only observed trace amounts (6–12 ppm) as was found in water supply. Not much of change with addition of odor product or rinse step.

Next, another test conducted.

| Light Fire - Program Nos. 1 and 2 - Whites | |
|---|---|
| Suds | 8 oz. |
| Bleach/Suds | 6 oz. |
| 2nd Bleach | 2 oz. |
| Total | 16 oz. |

On both whites and colors, with light fire, the same dose amounts of builder was used.

Next, another test was conducted.

| Light Fire - Program Nos. 3 and 4 - Whites Builder Dose Reduced by Half | |
|---|---|
| 1st Suds | 4 oz. |
| 2nd Suds | 3 oz. |
| Carryover Suds | 1 oz. |
| Total | 8 oz. |

Next, another test was conducted.

| Heavy Fire - Program Nos. 11 and 12 - Whites | |
|---|---|
| Break | 10 oz. |
| Suds | 8 oz. |
| Bleach | 6 oz. |
| Total | 24 oz. |

Next, another test was conducted.

| Light Fire - Program Nos. 13 and 14 - Colors<br>Builder Dose Reduced by Half | |
|---|---|
| Break | 5 oz. |
| Suds | 4 oz. |
| Carryover Suds | 3 oz. |
| Total | 12 oz. |

The above tests helped to develop the programs and amounts.

Thus, there has been shown and described at least one preferred embodiment of a system, process for restoring smoke and water damaged garments. It is apparent to those skilled in the art, however, that many changes, variations, modifications, and other uses and applications for the above-described processes and systems, including its subprocesses and components are possible, and also such changes, variations, modifications, and other uses and applications which do not depart from the spirit and scope of the invention are deemed to be covered by the invention, which is limited only by the claims which follow.

What is claimed is:

1. A method for restoring smoke-damaged garments, consisting of:

chilling water to 55° F.;

ozonating the water in a holding tank or a supply tank;

forming a first ozonated water composition having an approximately neutral pH comprising the ozonated water and additives, wherein the first ozonated water compositon is at a temperature of 55° F.;

contacting the first ozonated water composition with at least one smoke-damaged garment while the first ozonated water composition is maintained at 55° F.;

draining the first ozonated water composition and rinsing the at least one smoke-damaged garment with water;

forming a second ozonated water composition having an approximately neutral pH and comprising the ozonated water and additives, wherein the second ozonated water composition is at a temperature of 55° F.; wherein the additives in the second ozonated composition are different than the additives in the first ozonated water composition; and contacting the second ozonated water composition with the at least one smoke-damaged garment while the second ozonated water composition is maintained at 55° F.

2. The method of claim 1, wherein a concentration of the ozone in the ozonated water compositions is between 0.550 ppm and 0.750 ppm.

3. The method of claim 1, wherein a concentration of the additives in the ozonated water compositions is between about 0.5 oz. additive/10 lbs. of garments and about 3 oz. additive/10 lbs. of garments.

4. The method of claim 1, wherein the additives are selected from the group consisting of cold water detergents and solvents.

5. The method of claim 1, wherein ozonating the water is selected from the group consisting of bubbling, side arm, direct injection, and precharged tank.

6. The method of claim 1, wherein the additives are selected from the group consisting of detergents, surfactants, solvents, bleach, and sour.

7. The method of claim 1, wherein the additives are selected from the group consisting of d-limonene based solvent, alkali builder, surfactant, bleach, odor controller, and sour and soften agent.

8. A method for restoring smoke-damaged garments, comprising:

chilling water to 55° F.;

ozonating the water in a holding tank or a supply tank;

forming a first ozonated water composition having an approximately neutral pH comprising the ozonated water and additives, wherein the first ozonated water composition is at a temperature of 55° F.;

contacting the first ozonated water composition with at least one smoke-damaged garment while the first ozonated water composition is maintained at 55° F.;

draining the first ozonated water composition and rinsing the at least one smoke-damaged garment with water;

forming a second ozonated water composition having an approximately neutral pH and comprising the ozonated water and additives, wherein the second ozonated water composition is at a temperature of 55° F.; wherein the additives in the second ozonated composition are different than the additives in the first ozonated water composition; and contacting the second ozonated water composition with the at least one smoke-damaged garment while the second ozonated water composition is maintained at 55° F.

9. The method for restoring smoke-damaged garments of claim 8, wherein a concentration of the ozone in the ozonated water compositions is between 0.550 ppm and 0.750 ppm.

10. The method for restoring smoke-damaged garments of claim 8, wherein a concentration of the additives in the ozonated water compositions is between about 0.5 oz. additive/10 lbs. of garments and about 3 oz. additive/10 lbs. of garments.

11. The method for restoring smoke-damaged garments of claim 8, wherein the additives are selected from the group consisting of detergents, surfactants, solvents, bleach, and sour.

12. The method for restoring smoke-damaged garments of claim 8, wherein the additives are selected from the group consisting of d-limonene based solvent, alkali builder, surfactant, bleach, odor controller, and sour and soften agent.

13. A method for restoring smoke-damaged garments, comprising:

chilling water to 55° F.;

ozonating the water in a holding tank or a supply tank;

forming a first ozonated water composition comprising the ozonated water and additives, wherein the first ozonated water composition is at a temperature of 55° F., wherein the first ozonated water composition is at a pH range of 6.5 to 8.5;

contacting the first ozonated water composition with at least one smoke-damaged garment while the first ozonated water composition is maintained at 55° F.;

draining the first ozonated water composition and rinsing the at least one smoke-damaged garment with water;

forming a second ozonated water composition comprising the ozonated water and additives, wherein the additives in the second ozonated composition are different than the additives in the first ozonated water composition; wherein the second ozonated water composition is at a temperature of 55° F., wherein the second ozonated water composition is at a pH range of 6.5 to 8.5; and contacting the second ozonated water composition with the at least one smoke-damaged garment while the second ozonated water composition is maintained at 55° F.

14. A method for restoring smoke-damaged garments, consisting essentially of:

chilling water to 55° F.;

ozonating the water in a holding tank or a supply tank;

forming a first ozonated water composition having an approximately neutral pH comprising the ozonated water and additives, wherein the first ozonated water composition is at a temperature of 55° F.;

contacting the first ozonated water composition with at least one smoke-damaged garment while the first ozonated water composition is maintained at 55° F.;

draining the first ozonated water composition and rinsing the at least one smoke-damaged garment with water;

forming a second ozonated water composition having an approximately neutral pH and comprising the ozonated water and additives, wherein the additives in the second ozonated composition are different than the additives in the first ozonated water composition; wherein the second ozonated water composition is at a temperature of 55° F.; and contacting the second ozonated water composition with the at least one smoke-damaged garment while the second ozonated water composition is maintained at 55° F.

* * * * *